US006260491B1

(12) United States Patent
Grusha

(10) Patent No.: US 6,260,491 B1
(45) Date of Patent: Jul. 17, 2001

(54) NOZZLE FOR FEEDING COMBUSTION PROVIDING MEDIUM INTO A FURNACE

(75) Inventor: John Grusha, Bethlehem, PA (US)

(73) Assignee: Foster Wheeler Corporation, Clinton, NJ (US)

( * ) Notice: Subject to any disclaimer, the term of this patent is extended or adjusted under 35 U.S.C. 154(b) by 0 days.

(21) Appl. No.: 09/394,417

(22) Filed: Sep. 13, 1999

(51) Int. Cl.[7] ..... F23D 1/00

(52) U.S. Cl. ..... 110/261; 110/265; 239/418; 239/423; 239/424

(58) Field of Search ..... 431/173, 189, 431/164, 8, 10; 239/128, 418, 423, 424, 450, 590.5, 502, 505, 518; 110/260, 261, 265

(56) References Cited

U.S. PATENT DOCUMENTS

| | | | | |
|---|---|---|---|---|
| 2,895,435 | * | 7/1959 | Bogot et al. | 110/28 |
| 3,363,843 | * | 1/1968 | Ballard et al. | 239/504 |
| 3,638,865 | * | 2/1972 | McEneny et al. | 239/424 |
| 4,348,170 | * | 9/1982 | Vatsky et al. | 431/188 |
| 4,356,975 | * | 11/1982 | Chadshay | 239/419.5 |
| 4,434,727 | * | 3/1984 | McCartney | 110/347 |
| 4,611,543 | * | 9/1986 | Collette | 110/263 |
| 5,461,990 | * | 10/1995 | Newman | 110/261 |
| 5,464,344 | * | 11/1995 | Hufton | 431/10 |
| 6,089,171 | * | 7/2000 | Fong et al. | 110/263 |
| 6,145,449 | * | 11/2000 | Kaneko et al. | 110/261 |

FOREIGN PATENT DOCUMENTS

| | | |
|---|---|---|
| 0 869 313 | 10/1998 | (EP) . |
| WO 98/01704 | 1/1998 | (WO) . |

* cited by examiner

*Primary Examiner*—Denise L. Ferensic
*Assistant Examiner*—K. B. Rinehart
(74) *Attorney, Agent, or Firm*—Fitzpatrick, Cella, Harper & Scinto

(57) ABSTRACT

A nozzle for feeding combustion maintaining medium into a furnace at high temperature conditions includes a nozzle tip, at least partly protruding into the furnace, and a feeding mechanism for feeding the combustion medium from a source of the medium to the nozzle tip. The nozzle tip includes a mainly open ended outer shell, an air cooling zone, a shroud, and an air channel. The outer shell includes a first end wall portion in flow connection with the feeding mechanism and a second end wall portion protruding into the furnace. The cooling zone is formed on the interior side of at least a portion of the second end wall portion of the outer shell, by providing an air flow along the interior side. The shroud includes a shroud wall portion disposed to cover at least a portion of the first end wall portion of the outer shell. The shroud channel is formed between the shroud wall portion of the shroud and the first end wall portion of the outer shell, for discharging from the shroud channel an air shroud flow along the exterior side of the second end wall portion of the outer shell.

22 Claims, 4 Drawing Sheets

NOZZLE FOR FEEDING COMBUSTION PROVIDING MEDIUM INTO A FURNACE

The present invention relates to nozzles feeding combustion providing medium into furnaces. The present invention thereby typically, but not exclusively, relates to pulverized coal feeding nozzles and secondary air nozzles in tangentially fired burners in steam generation boilers. Tangential firing is described in U.S. Pat. No. 4,252,069, U.S. Pat. No. 4,634,054 and U.S. Pat. No. 5,483,906.

Pulverized coal feeding burners typically have pivotably arranged coal nozzle tips protruding into the furnace. The coal nozzle tips have a double shell configuration, comprising an outer shell and an inner shall. The inner shell is coaxially disposed within the outer shell to provide an annular space between the inner and outer shells. The inner shell is connected to a fuel feeding conduit or pipe, for feeding pulverized coal entrained in an air flow through the inner shell into the furnace. The annular space is connected to a secondary air conduit for feeding secondary air through said channel into the furnace. The secondary air is meant to provide combustion air and cool the outer shell. The fuel feeding pipe is typically disposed axially in the secondary air conduit.

The nozzle tip is located in an opening in a nozzle supporting wall, typically in the outlet of the secondary air box. The external cross section of the nozzle tip is typically rectangular and mainly corresponds to the internal cross section of the outlet end of the air conduit. Narrow gaps typically remain between the peripheral walls of the nozzle tip and the walls of the air conduit. Secondary air is allowed to leak through the narrow gaps. The air typically flows horizontally into the furnace. When the nozzle tips are arranged to discharge fuel and air horizontally into the furnace, the air leaking through the gaps will flow mainly in the direction of the external walls of the nozzle tips and thus protects its wall plates from furnace radiation heat.

The coal nozzle tip is typically pivotably connected to the fuel feeding pipe, in order to be able to control the level of the fire ball in tangential firing. Thus, when the nozzle tip is tilted to provide an upward or downward flow of fuel and air into the furnace, one of its walls will be bent away from the air flow leaking out and thus be more or less unprotected.

Fuel, as well as secondary air nozzle tips of tangential fired boiler units are exposed to severe furnace conditions that can lead to thermal distortion and/or high temperature oxidation. This problem requires operators to annually replace many of their coal and air nozzle tips at a fairly high cost. Especially on tangentially fired boiler units, the conditions of the nozzle tips play a key role in sustaining long term optimal combustion performance.

It has been noticed that the cooling air flow flowing within the nozzle tip of fuel or air feeding nozzles cannot at certain high temperature conditions provide a sufficient cooling of the external walls of the nozzle tips. Thus, the external wall plates may be heavily damaged, leading to the above mentioned problems.

Exposure to direct radiation, particularly when nozzle tips are up- or downward tilted induces thermal gradients through thick stainless steel plates, ¼ to ¾ inch thick. The thermal gradient causes distortion and eventually closure of the passages in the nozzles, leading to performance degradation. Exposure to high radiation also results in operating temperatures exceeding material limits and eventual oxidation and thinning effect of the plate resulting in "burnback" and eventual performance degradation.

It is an object of the present invention to provide an improved nozzle with which the above problems may be avoided or at least minimized.

It is particularly an object of the present invention to provide a nozzle the external walls of which are well protected from heat radiation.

The objects of the present invention are achieved by nozzles comprising the characterizing features mentioned by the appended claims.

The present invention provides a nozzle, for feeding combustion maintaining medium into a furnace at high temperature conditions. A nozzle according to the present invention includes, according to a preferred embodiment, a nozzle tip and fuel and/or air feeding means.

The nozzle tips may be pivotably mounted, e.g., to fuel feeding pipes, air feeding boxes, such as windboxes, furnace wall constructions or any other suitable conveniently located constructions. The nozzle tips are disposed so as to protrude at least partly into the furnace. Typically, several nozzles may be disposed one on top of the other and be connected to a vertical box mounted to the furnace wall, preferably in a corner area thereof.

A combustion maintaining medium, such as pulverized coal and air, may be fed through the feeding means and the nozzle tips into the furnace. Typically, pulverized coal is fed as a mixture with transport air. Secondary air may be fed separately from the coal. The nozzles may be used to feed other suitable fuels and gases, as well.

The nozzle tip according to a preferred embodiment of the present invention typically includes a mainly open-ended outer shell and a shroud means covering a portion of the outer shell. At the first end of the outer shell the passage inside the outer shell is in flow connection with the air feeding means. The other end of the outer shell typically protrudes into the furnace. The outer shell typically is of a square or rectangular cross section, having rounded corners.

The shroud means is typically made of a shroud plate which is disposed to cover a portion of the first end of the outer shell. A gas space is formed between the shroud plate and the covered portion of the outer shell. Shroud air, such as secondary air, is led through the gas space and discharged along the uncovered surface of the outer shell, thus providing protection against radiation heat to the outer shell. The shroud, i.e., the plate work thereof, may be recessed, to form a bulbous shape and, therefore, be self protected from much of the radiation. Some leak air will also flow rather close to the first end of the shroud even if the nozzle tip is tilted. The leak air only later deviates from the nozzle tip and thus, the leak air also provides some protection close to the windbox.

Shroud plates are typically mounted to cover a portion of the upper and bottom sides of the outer shell. The shroud plate may be formed to guide the shroud air in a desired direction and to provide the desired form of shroud air flow. The shroud channels or directs cooling air along the outer shell, outer plate work, of the coal of air nozzle tips, thereby providing additional cooling to those sections more exposed to radiation.

The nozzle tips further include an air cooling zone formed peripherally on the interior side of at least a portion of the outer shell. An air flow is maintained along the interior side of the outer shell in the air cooling zone.

The nozzles according to the present invention are especially suitable for feeding fuel and air into tangentially fired furnaces, as the nozzles tips may be pivotably mounted, so as to allow the direction of the flow from the nozzles to be changed. The flow may be directed upward or downward in order to control the combustion process in the furnace. Nozzle tips may be tilted either up or down typically ±30°. The present invention maintains an air shroud and cooling along the outer shell surface even in extreme tilted positions.

The shroud means suggested by the present invention may be used to protect air nozzles from radiation in furnaces, as well. Then, the air flowing through the nozzle provides the interior cooling of the outer shell and an additional air flow guided by the shroud means provides the outer protection of the nozzle tip.

The present invention provides effective radiation heat protection. High velocity jets, 85 ft/sec to 250 ft/sec, of air are strategically directed from specifically designed channels and blanket the nozzle tip with cooling air. The air shroud provides added cooling of the nozzle and decreases a thermal gradient across the plate material, due to double-sided cooling by air. The combined effect of the air flows in the shrouded nozzle tip reduces the thermal stresses and the subsequent distortion.

The shrouded nozzle tip can be used to replace existing nozzles in existing windboxes or other supporting structures. The nozzle tips are easy to mount to existing assemblies. The operating life of the new nozzle tips is long, which reduces costs. The fuel and air mixing performance is maintained for a longer time as the nozzle tip is maintained undamaged. Also, combustion efficiency is maintained over extended periods.

The present invention will be described in more detail by reference to the enclosed drawings in which FIG. 1 shows a diagrammatic view of a boiler employing the tangential firing method;

Figure 1:
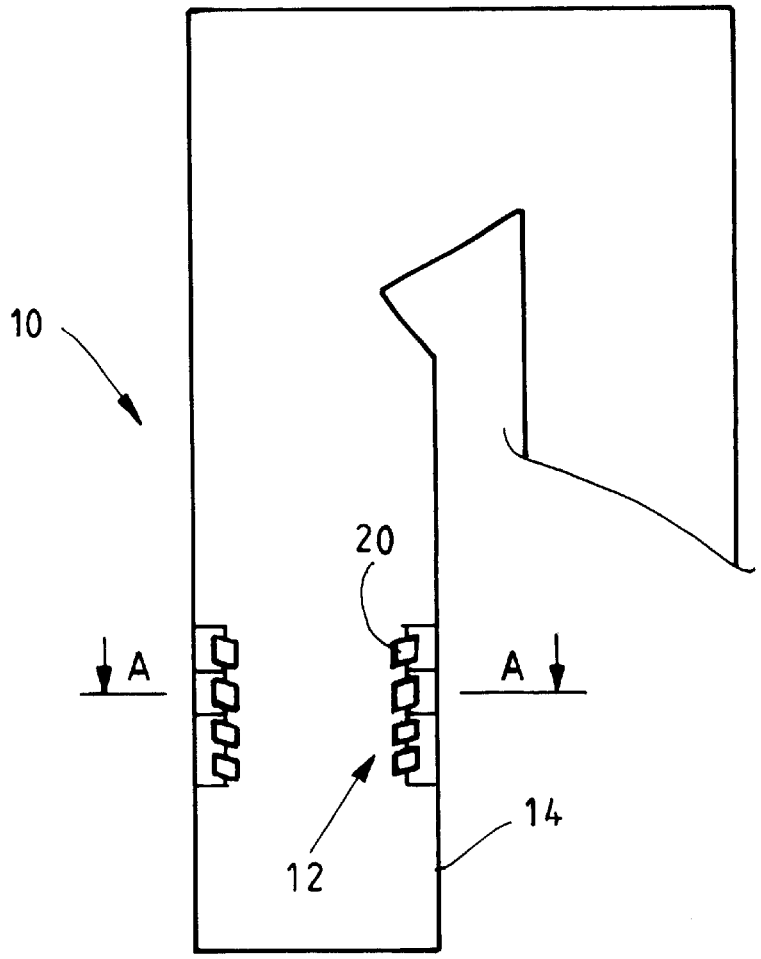
Figure 2:
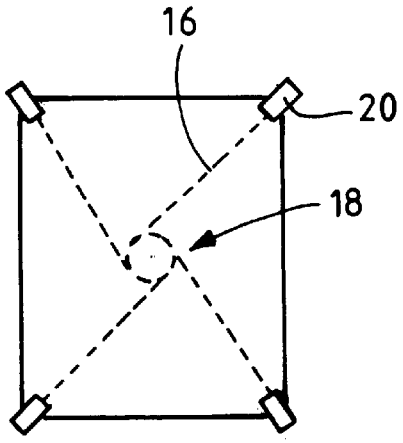
FIG. 2 shows a cross-sectional view of FIG. 1 along line AA.

FIGS. 1 and 2 show a furnace 10 utilizing tangential firing. Nozzle assemblies 12 are mounted to the walls 14 in the corner areas. Fuel and air flows 16 are directed tangentially toward a fire ball 18 in the center of the furnace. The fire ball may be lifted or allowed to fall by tilting the nozzles 20 in the nozzle assemblies upward or downward.

Figure 3:
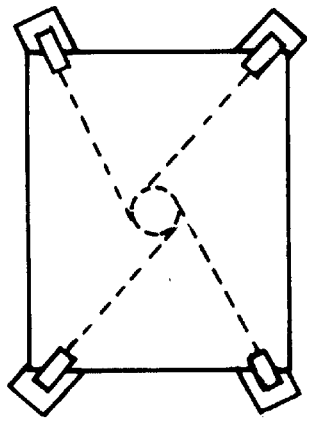
FIG. 3 shows a cross-sectional view according to FIG. 2 of another furnace.

The nozzle assemblies may be arranged directly in the corners or close to the corner areas as shown in FIG. 3.

Figure 4:
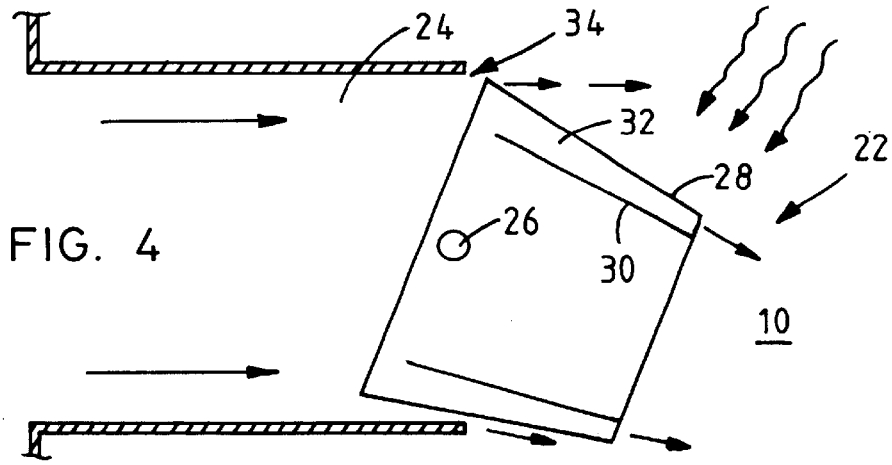
FIG. 4 shows a diagrammatic vertical cross-sectional view taken in the flow direction of a coal nozzle tip according to the prior art.

FIG. 4 shows a conventional coal nozzle 20 for fuel feeding. The nozzle tip 22 is mounted in the outlet end of a secondary air conduit 24. The nozzle tip 22 is pivotably mounted around an axis 26. The nozzle 20 comprises an outer shell 28 and an inner shell 30 and an annular air channel 32 between the shells. Air is fed from the secondary air conduit 24 into air channels 32 in the nozzle tip 22 and discharged into the furnace 10. Additional air is leaking in horizontal air flows through openings 34 from the secondary air conduit 24 to the furnace 10 externally of the nozzle tip 22. Fuel is fed via conduits (not shown in the drawing) through the central parts of the air conduit 24 and nozzle tip 22 into the furnace 10.

The nozzle tip 22 in FIG. 4 is tilted downward. Thus, air leaking through opening 34 will not follow the upper wall of the outer shell of the nozzle tip but will deviate away from the nozzle. The upper side of the wall will be unprotected against radiation and may be damaged.

Figure 5:
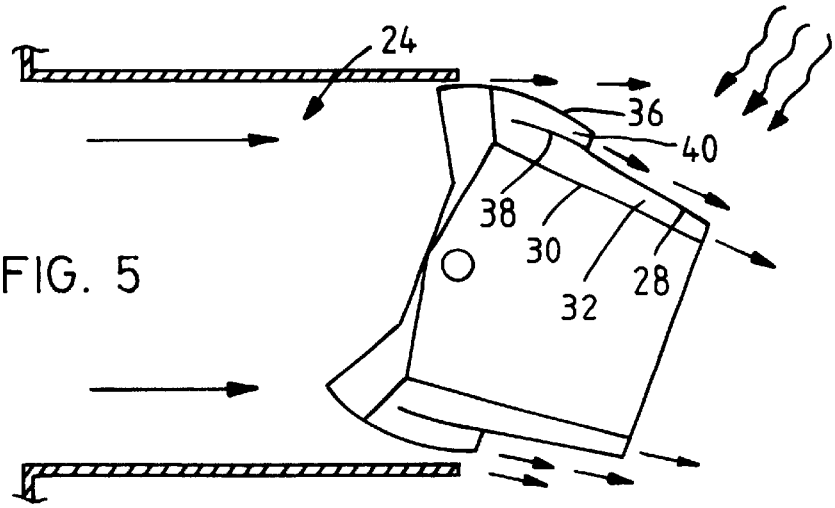
FIG. 5 shows a cross-sectional view similar to FIG. 4, but of a nozzle tip in accordance with the present invention.

FIG. 5 shows in a similar view a nozzle tip according to the present invention. The same reference numerals as used in FIGS. 1 to 4 will be used. The nozzle tip is made of an outer shell 28 and an inner shell 30 coaxially located within the outer shell. Additionally, a shroud means 36 is disposed on the first end portion 38 of the outer shell, i.e., the end more close to the feeding means 24, to cover the first portion of the outer shell.

The shroud means 36 forms with the first end portion of the outer shell 28 a space 40 or slot. Air is introduced into this space 40 from the air conduit 24. According to the present invention, an air flow from the air conduit 24 may be divided or split up to flow partly into the space 32 between the outer shell and the inner shell and to flow partly into the space 40 between the outer shell and the shroud means. From the space 40 air is discharged to flow along the external surface of the outer shell and to thus protect the shell against radiation. The shroud means 36 provides a well directed flow of cooling air, as is shown by arrows.

The nozzle tips may be formed or shells having a square, rectangular or circular cross section forming annular spaces therebetween. The shroud may if desired be of a similar square, rectangular or circular cross section, but is typically made of plate material covering only the upper and bottom sides of the outer shell. An increased protection against radiation is typically mostly needed on the upper and bottom sides of the nozzle tip.

Figure 6:
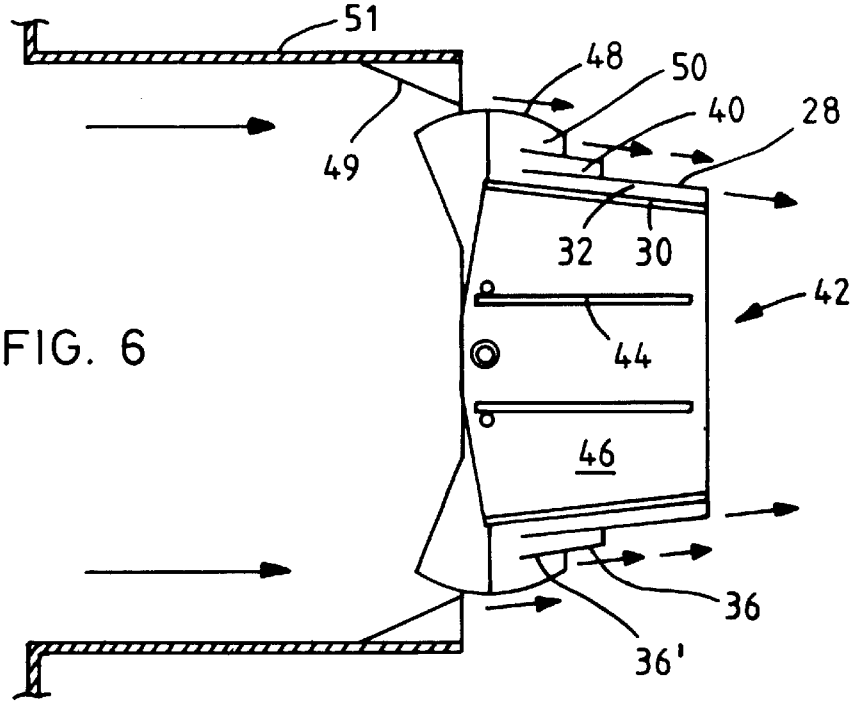
FIG. 6 shows a diagrammatic vertical cross-sectional view taken in the flow direction of a nozzle tip in accordance with the present invention.

FIG. 6 shows a slightly different drawing of a nozzle tip in accordance with the present invention. The same reference numerals will be used as in earlier FIGS. 1 to 5. It is shown in FIG. 6 that the nozzle tip includes an inner part 42 delimited by an inner shell 30, for feeding coal. The inner part is divided by splitters 44 into separate flow channels 46. The fuel feeding conduit introducing fuel into the nozzle tip is not shown.

A multishroud construction is used to cover the outer shell 28. An air channel 32 is formed between the outer shell and the inner shell as in FIG. 5. The first half 38 of the upper side of the outer shell 28 is covered by a first shroud 36. A first air shroud channel 40 is formed between the shell 28 and the shroud 36.

A second shroud 48 is used to cover a first portion 36' of the first shroud 36. Thus, a second air shroud channel 50 is formed between the first shroud portion 36' and the second shroud 48.

A multi-air shroud, partly from channel 40 and partly from channel 50, is guided to flow along the upper side of the nozzle tip. The air shroud from the second air channel will protect the outer shell and the first shroud from radiation. It is, of course, possible to add even more shrouds on top of each other in a similar manner in order to provide a multishroud construction. Deflectors 49 between wall plates 51 and shroud 48 are not required if wall plates 51 are moved closer to the nozzle tip.

Figure 7:
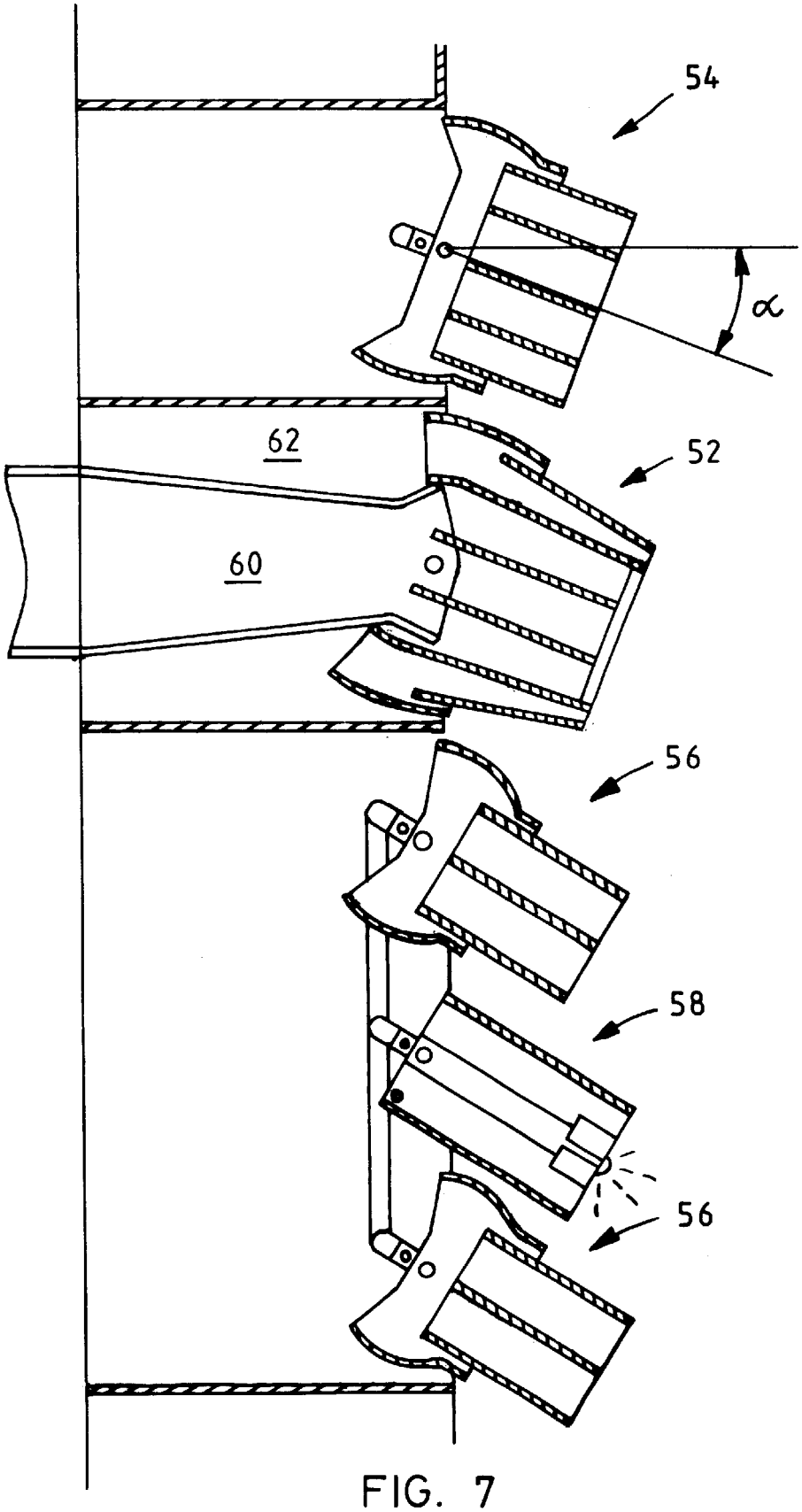
FIG. 7 shows a diagrammatic vertical cross-sectional view taken in the flow direction of the nozzles of a nozzle assembly in accordance with the present invention and FIG. 8 shows a diagrammatic axonometric front view of a coal nozzle tip according to the present invention.

FIG. 7 shows a nozzle assembly, comprising a coal feeding nozzle tip 52, an upper single air feeding nozzle tip 54, and lower air feeding nozzle tip 56 surrounding an oil burner 58 for start up.

The shrouds 36 shown in nozzle tips 52, 54 and 56 in FIG. 7 are bulbous. The shrouds could be non-bulbous if desired. FIG. 7 shows more clearly than FIG. 6, how the coal feeding nozzle tip 52 may be pivotably connected to a coal feeding pipe 60 disposed axially within a secondary air conduit 62, such as a windbox. The air feeding nozzles are connected to secondary air boxes, such as windboxes. The nozzle tips are downward tilted, such that the axis of the nozzle tip forms an angle α with the longitudinal plane. The angle α may be ±30° from horizontal.

Figure 8:
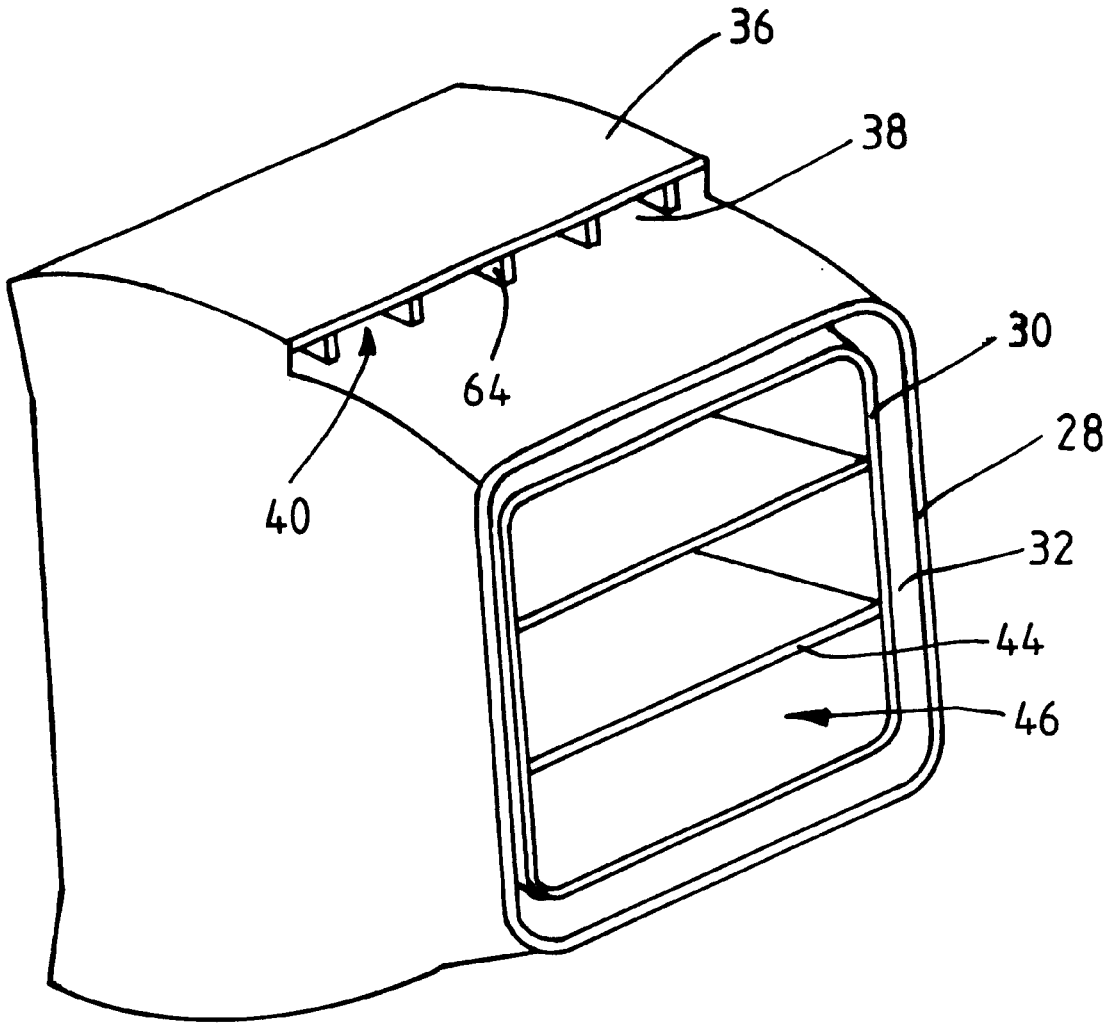

FIG. 8 shows a single coal feeding nozzle tip. The same reference numbers will be used as in FIG. 6. The nozzle tip is made of an inner shell 30 and an outer shell 28, which are disposed coaxially. The interior coal feeding space within the inner shell is divided by splitter plates 44 into single coal feeding subpassages 46. The annular space between the outer and inner shell provides a secondary air feeding channel 32.

A convex, curved shroud plate 36 is disposed on the upper side of the outer shell 28 to cover its first half 38. An air space 40 is formed between the outer shell and the shroud. Partition plates 64 are disposed in the space to form therein subpassages parallel with the flow of shroud air.

The present invention is not intended to be limited to the embodiments discussed in the description above, but will cover other embodiments included in the definition of the invention as defined in the appended claims. Thus, besides pulverized fuel and air nozzles, also overfire air, gas and oil nozzle tips are included in the scope of the invention.

What is claimed is:

1. A nozzle for feeding a combustion maintaining medium into a furnace at high temperature conditions, said nozzle comprising:

a tiltable nozzle tip, at least partly protruding into the furnace; and feeding means for feeding the combustion maintaining medium from a source of the medium to said tiltable nozzle tip, said tiltable nozzle tip including:

(i) a mainly open-ended outer shell, including a first end wall portion in flow connection with said feeding means and a second end wall portion protruding into the furnace, said second end wall portion having an interior side and an exterior side;

(ii) an air cooling zone formed on the interior side of at least a portion of said second end wall portion of said outer shell, and providing an air flow along the interior side;

(iii) a shroud being disposed on said tiltable nozzle tip, said shroud including a shroud wall portion disposed to cover at least a portion of the first end wall portion of said outer shell; and (iv) an air shroud channel, formed between said shroud wall portion of said shroud and the first end wall portion of said outer shell, for discharging from said air shroud channel an air shroud flow which is guided along the exterior side of the second end wall portion of said outer shell.

2. A nozzle according to claim 1, wherein said feeding means comprises fuel feeding means, and an open-ended inner shell, including a first end and a second end, disposed within said outer shell, the first end of said inner shell being connected to supporting means connected to the furnace.

3. A nozzle according to claim 2, wherein said feeding means further comprises a secondary air conduit, said air cooling zone being formed in a space between said outer shell and said inner shell and an inlet end of said air cooling zone being in flow connection with said secondary air conduit, for leading cooling air through the space between said outer shell and said inner shell.

4. A nozzle according to claim 3, wherein said fuel feeding means comprises a pulverised coal feeding pipe and said coal feeding pipe is disposed within said secondary air conduit.

5. A nozzle according to claim 4, wherein said coal feeding pipe is disposed coaxially within said secondary air conduit.

6. A nozzle according to claim 2, wherein said inner shell is disposed coaxially within said outer shell and an annular open-ended space is formed between said inner and outer shells, at least a portion of the annular space forming said air cooling zone.

7. A nozzle according to claim 2, further comprising at least one baffle plate for dividing said inner shell into at least two open-ended fuel feeding passages.

8. A nozzle according to claim 7, wherein each baffle plate comprises splitter plates.

9. A nozzle according to claim 2, wherein said inner shell is pivotably connected to said fuel feeding means.

10. A nozzle according to claim 2, wherein said fuel feeding means is arranged to feed a mixture of pulverized coal and transporting air.

11. A nozzle according to claim 2, wherein said outer shell is formed of a mainly square, smoothly cornered outer casing and said inner shell is formed of a mainly square, smoothly cornered inner casing, smaller in cross section than said outer shell and disposed axially within said outer shell.

12. A nozzle according to claim 1, wherein said shroud wall portion comprises a shroud wall plate disposed to cover a portion of an upper side wall of said outer shell and a shroud wall plate disposed to cover a portion of a bottom side wall of said outer casing.

13. A nozzle according to claim 1, wherein a vertical cross section of a first end in the flow direction of said shroud wall plate taken parallel to the flow direction is convex.

14. A nozzle according to claim 1, wherein said feeding means comprises an air flow conduit, in flow connection with an air source, and said outer shell is divided by at least one baffle plate, parallel with the air flow, into at least two air flow subpassages, said air flow subpassages having an inlet end and an outlet end, the inlet ends of said air flow subpassages being in flow connection with said air flow conduit, and the outlet ends of said air flow subpassages being arranged to discharge air into the furnace.

15. A nozzle according to claim 14, wherein said air source comprises a windbox.

16. A nozzle according to claim 14, wherein said air cooling zone is formed in one of said air flow subpassages delimited by said outer shell and one of said baffle plates.

17. A nozzle according to claim 16, wherein at least two air cooling zones are formed in at least two of said air flow subpassages, each being delimited by said outer shell and one of said baffle plates.

18. A nozzle according to claim 1, wherein said nozzle tip is pivotably connected to a supporting construction of the furnace.

19. A nozzle according to claim 18, wherein the supporting construction comprises a furnace wall.

20. A nozzle according to claim 18, wherein the supporting construction comprises a windbox.

21. A nozzle according to claim 1, wherein said shroud wall portion covers in the air flow direction maximally only 50% of the length of said outer shell, leaving the second end of said outer shell protruding into the furnace uncovered.

22. A nozzle according to claim 1, wherein said nozzle tip comprises multishroud means including said first shroud wall portion, said first shroud wall portion including in the flow direction a first end, and externally of said first shroud wall portion, a second shroud wall portion covering the first end thereof.

* * * * *

UNITED STATES PATENT AND TRADEMARK OFFICE

CERTIFICATE OF CORRECTION

PATENT NO. : 6,260,491 B1
DATED : July 17, 2001
INVENTOR(S) : John Grusha

It is certified that error appears in the above-identified patent and that said Letters Patent is hereby corrected as shown below:

Title page,
Item [56], under U.S. PATENT DOCUMENTS, please add the following:

| | | | |
|---|---|---|---|
| -- 5,483,906 | 1/1996 | Hufton | 110/260 |
| 4,634,054 | 1/1987 | Grusha | 239/423 |
| 4,252,069 | 2/1981 | McCartney | 110/104B --. |

Signed and Sealed this

Twenty-seventh Day of August, 2002

*Attest:*

*Attesting Officer*

JAMES E. ROGAN
*Director of the United States Patent and Trademark Office*